US006913542B1

(12) United States Patent
Hu et al.

(10) Patent No.: US 6,913,542 B1
(45) Date of Patent: Jul. 5, 2005

(54) GOLF CLUB FOR SHOWING SWING CONDITION

(76) Inventors: Chin-Te Hu, No. 211-13, Chu Kuang Rd., Chungho City, Taipei Hsien (TW); Yung-Tsao Chou, No. 211-13, Chu Kuang Rd., Chungho City, Taipei Hsien (TW)

( * ) Notice: Subject to any disclaimer, the term of this patent is extended or adjusted under 35 U.S.C. 154(b) by 0 days.

(21) Appl. No.: 10/753,427

(22) Filed: Jan. 9, 2004

(51) Int. Cl.[7] ..... A63B 69/36
(52) U.S. Cl. ..... 473/220; 473/223
(58) Field of Search ..... 473/219–221, 473/222–226

(56) References Cited

U.S. PATENT DOCUMENTS 2,787,470 A * 4/1957 Barrus ..... 473/220
3,677,553 A * 7/1972 Moore ..... 473/220
4,515,368 A * 5/1985 Petitjean ..... 473/224
5,161,802 A * 11/1992 Daechsel ..... 473/220
5,288,080 A * 2/1994 Tice ..... 473/220
5,401,030 A * 3/1995 Halliburton ..... 473/220
5,630,764 A * 5/1997 McNair ..... 473/220
5,692,964 A * 12/1997 Smith et al. ..... 473/220
5,839,969 A * 11/1998 Klouda ..... 473/220
5,895,328 A * 4/1999 Pahio ..... 473/224

* cited by examiner

*Primary Examiner*—Gregory Vidovich
*Assistant Examiner*—Nini F. Legesse
(74) *Attorney, Agent, or Firm*—Rosenberg, Klein & Lee

(57) ABSTRACT

A golf club for showing swing condition has a shaft and a head connecting to the shaft, and the head having a striking face. The golf club has a visible illuminant that is mounted on the head and exposed outside the head with an upward angle. A battery is for providing electrical power to the light. A centrifugal switch that is actuated by centrifugal force is mounted on the head opposite the striking face for controlling a circuit between the battery and the illuminant. Thereby the illuminant will light by a predetermined-strength centrifugal force during swinging the golf club for investigating the body harmony and strength-exerting condition of golfer.

3 Claims, 6 Drawing Sheets

GOLF CLUB FOR SHOWING SWING CONDITION

BACKGROUND OF THE INVENTION

1. Field of the Invention

The present invention relates to a golf club for showing swing condition, and particularly to a golf club with an illuminate lighting by a predetermined-strength centrifugal force during swinging the golf club for being an education tool.

2. Description of the Prior Art

Golf is a game of ever increasing popularity, and it requires a player to precisely and accurately control both the point at which the club face strikes the ball, and the path of travel of the club, before, during and after contact with the ball. Such control is important in all aspects of the game, but is particularly important when it comes to putting.

A number of aiming devices have been developed to aid golfers in controlling and directing their strokes; but the art has not acknowledged the need for, or provided any, device for tracking the motion of a golf club.

While there are many aiming devices known in the prior art, such devices suffer from a number of shortcomings. First of all, these devices do not provide any means by which a point on a moving club may be tracked. Furthermore, some prior art devices require laser light device, that must avoid to hurt eyes and exists a hidden dangerous.

There is presently, and there has been a consistent problem regarding the golf club of prior art.

SUMMARY OF THE INVENTION

The main object of the present invention is to provide a golf club for showing swing condition, particular to a golf club can show the force-exerting condition of the golfer during swinging for observing by coach as an education tool.

In order to achieve the above object, the present invention provides a golf club for showing swing condition having a shaft and a head connecting to the shaft, and the head having a striking face. The golf club has a visible illuminant that is mounted in the head and exposed outside the head with an upward angle; a battery is for providing electrical power to the light; and a centrifugal switch that is actuated by centrifugal force and mounted on the head opposite the striking face for controlling a circuit between the battery and the illuminant thereby the illuminant will illuminate by a predetermined-strength centrifugal force during swinging the golf club for investigating the body harmony and strength-exerting condition of golfer.

DESCRIPTION OF THE PREFERRED EMBODIMENT

Figure 1:
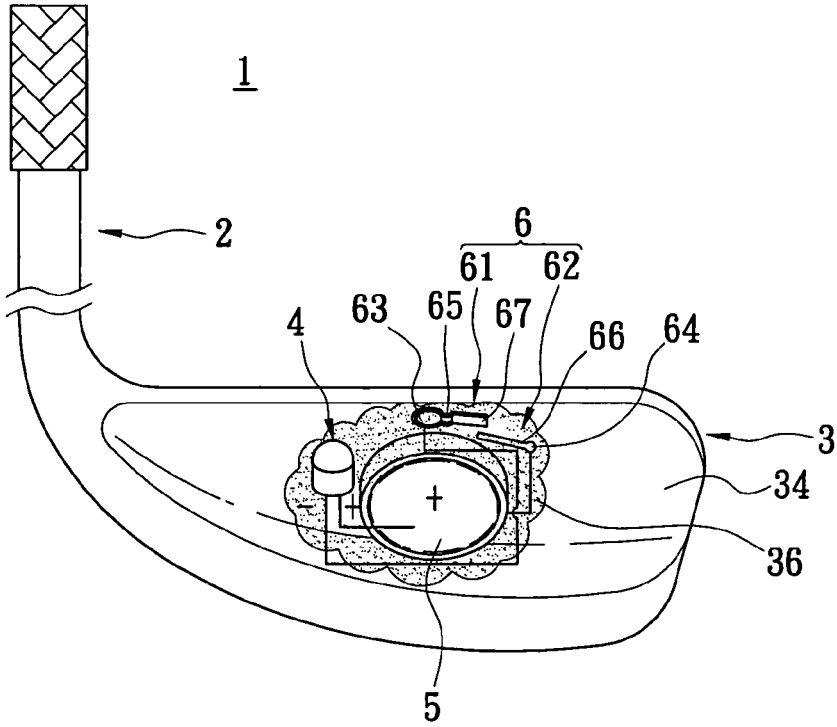
FIG. 1 is a back view of a golf club according to the present invention.

Referring to FIG. 1, which is a back view of a golf club according to the present invention during swinging, a golf club 1 for showing swing condition has a shaft 2 and a head 3 that is connecting to the shaft 2. In this embodiment, the head 3 has a striking face 32 and a concave back 34. However, the present invention also can be applied in another kinds of golf club.

The golf club 1 has an illuminant 4 that is mounted in the head 3 and exposed outside the head 3 with an upward angle, a proper amount of battery 5 that is for providing electrical power to the illuminant 4, and a centrifugal switch 6 actuated by centrifugal force for controlling the illuminant 4 on or off. The centrifugal switch 6 is fixed on a surface opposite the striking face 32 of the golf club 1 for controlling a circuit between the battery 5 and the illuminant 4.

The illuminant 4 must be a visible illuminant, and it can be a LED (Light Emitting Diode) or a light bulb. LED is cheaper and brighter, and also has various colors for selecting. The direction of the illuminant 4 is substantially parallel to the shaft 2 for observing the swing condition of the golfer. The illuminant 4 will light by a predetermined-strength centrifugal force during swinging the golf club.

In this embodiment of the present invention, the centrifugal switch 6 comprises an elastic control pole 61 and a fixed pole 62 that is fixed on the head 3. The control pole 61 moves along a direction of centrifugal force during swinging the golf club 1 to contact with the fixed pole 62. In which, the control pole 61 has a first fixed portion 63 that is fixed on the head 3, an elastic portion 65 that is extending upwardly from the first fixed portion 63, and a movable first contact portion 67 that is connecting with the elastic portion 65. The fixed pole 62 has a second fixed portion 64 that is fixed on the head 3 and a second contact portion 66 that is connecting with the second fixed portion 64 and positioned on a moving path of the first contact portion 67.

A positive contact of the illuminant 4 is connecting with a positive electrode of the battery 5, and a negative contact of the illuminant 4 is connecting with the control pole 61 of the centrifugal switch 6. The fixed pole 62 of the centrifugal switch 6 is connecting to a negative electrode (not labeled) of the battery 5. The battery 5 is fixed in a plastic seat.

The illuminant 4, the battery 5 and the centrifugal switch 6 could be fixed on the head 3 by adhesive 36, for example by silicon, and fixed on the back 34 of the head 3. The battery 5 is not limited to be mounted on the head 3. The battery 5 can also be mounted on the shaft 2 for avoiding from loosening via impact of string.

Figure 1A:
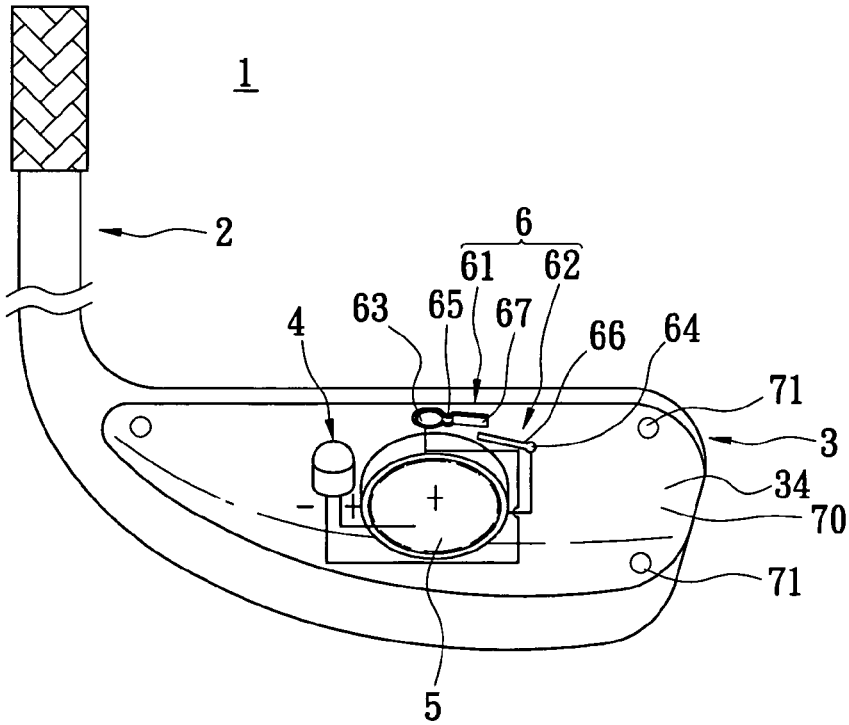
FIG. 1A is a back view of the golf club of another embodiment according to the present invention.

Referring to FIG. 1A, which is a back view of a head of the golf club according to another embodiment of the present invention. The illuminant 4, the battery 5 and the centrifugal switch 6 are fixed integrally on a bottom shell 70, and the bottom shell 70 is fixed on the head 3.

Figure 2:
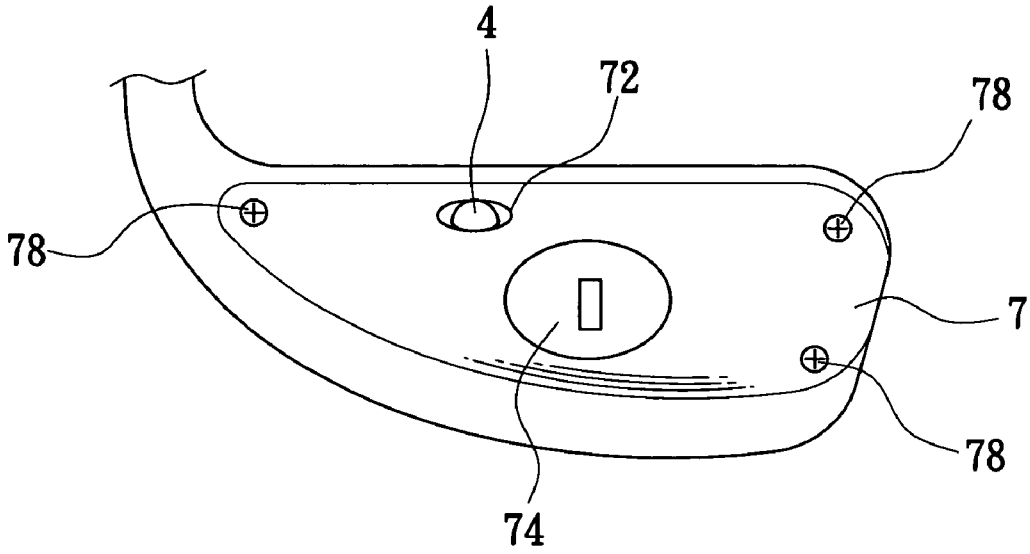
FIG. 2 is a back view of a head with a cover of the golf club according to the present invention.

Referring to FIG. 2, for prettifying and protecting the elements, the present invention further comprises a cover 7 that is fixed on the back 34 of the head 3 for covering the illuminant 4, the battery 5 and the centrifugal switch 6. The cover 7 comprises a light hole 72 for exposing the illuminant 4 outside, a detachable battery cover 74 that is mounted on the cover 7 for replacing the battery 5.

The detachable cover 7 also can be mounted on the bottom shell 70 by screwing on screw hole 71 thereof, and the cover 7 also comprises a light hole 72 for exposing the illuminant 4 outside, a detachable battery cover 74 that is mounted on the cover 7 for replacing the battery 5.

Figure 2A:
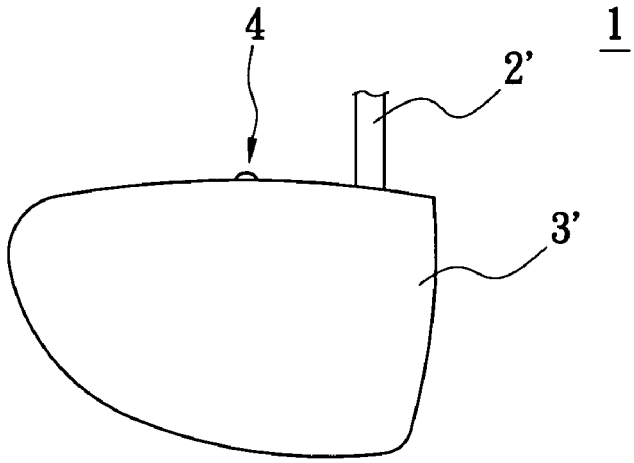
FIG. 2A is a front view of a head according to another embodiment the present invention.

Referring to FIG. 2A, which is a front view of a golf club according to another embodiment of the present invention. For different golf clubs have different head, for example iron head, wood head, putter head. In the FIG. 2A, a golf club 1 (like #1 DRIVE) has a hollow wood head 3', wherein the illuminant 4, the battery 5 and the switch 6 could be fixed in the head 3'(not shown). The illuminant 4 also can be fixed on a shell of the head 3', on condition that the illuminant 4 is exposed outside the head 3'.

Figure 3:
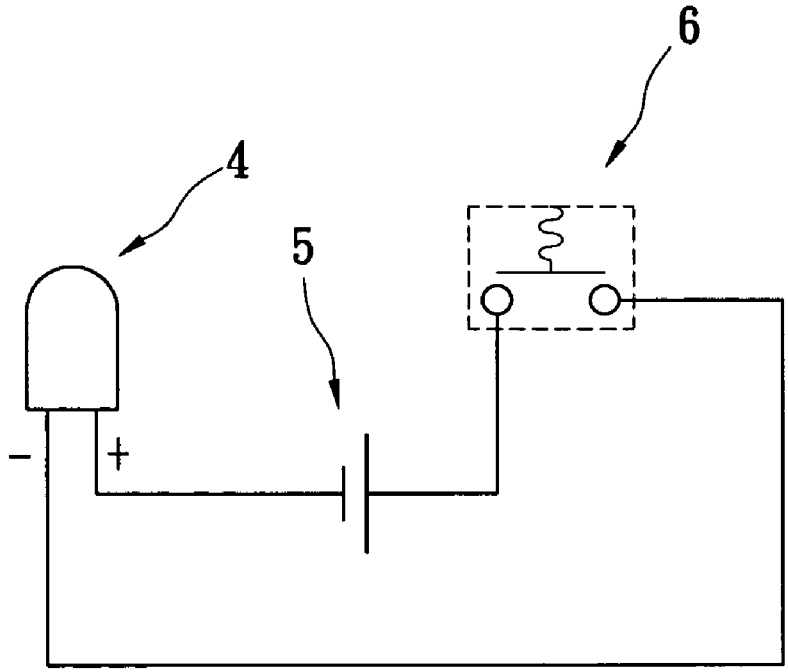
FIG. 3 is a circuit diagram according to the present invention.

Referring to FIG. 3, which is a circuit diagram according to the present invention. The key point of the present invention is the illuminant 4 exposed outside the head 3 and substantially parallel to the shaft 2, and the centrifugal switch 6 is mounted on an surface of the head 3 opposite the striking face 32. The battery 5 can be mounted on other place for avoiding from loosening. The centrifugal switch 6 is a preferred embodiment of the present invention. The centrifugal switch 6 is on condition of functioning by centrifugal force, such as the mercury type, the sealed rolling ball type, the sealed spring type, or sealed conductive needle type centrifugal switch. The centrifugal switches are set beforehand at a predetermined force and have option. When the golfer swinging the golf club 1 to a predetermined velocity, the centrifugal switch 6 will conduct and the illuminant 4 will light for observing the swinging condition of the golfer if the force-exerting is at right opportune moment.

Figure 4:
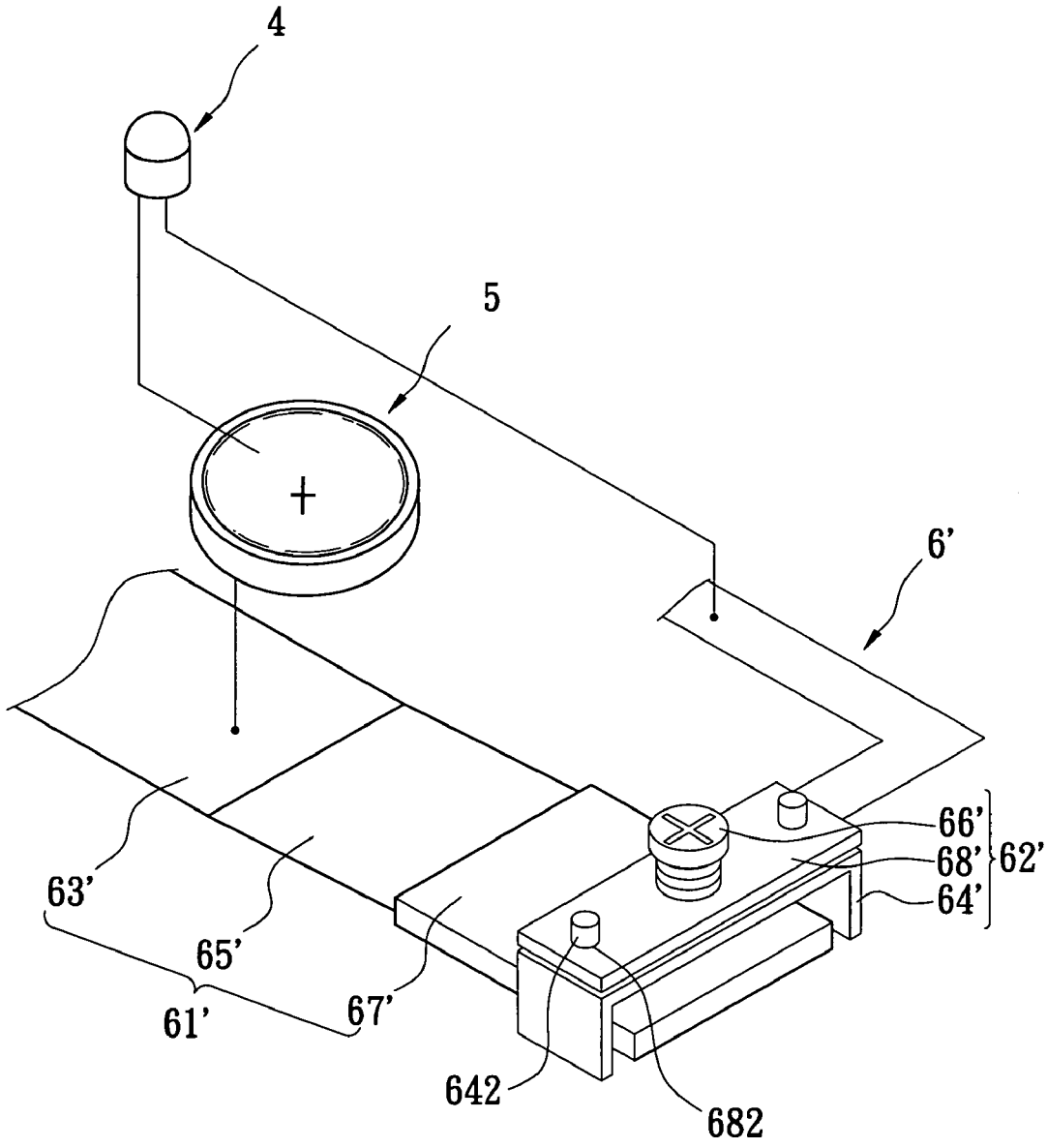
FIG. 4 is a perspective view of an adjustable centrifugal switch according to the present invention.

Referring to the FIG. 4, which is a perspective view of an adjustable centrifugal switch according to the present invention, the centrifugal switch can be an adjustable centrifugal switch 6' for being actuated by different predetermined-strength centrifugal forces. The adjustable centrifugal switch 6' has an adjustable pole 62', a movable elastic control pole 61' moving along a direction of centrifugal force to contact with the adjustable pole 62'. A distance between the adjustable pole 62' and the control pole 61' is adjustable for setting the adjustable centrifugal switch 6' to switch on via different-strength centrifugal forces. The elastic control pole 61' has a first fixed portion 63' fixed on the head 3 and connecting to the negative electrode of the battery 5, an elastic portion 65' extending from the fixed portion 63', and a first contact portion 67' connecting with the elastic portion 65' for contacting with the adjusting pole 62'. The adjusting pole 62' has a seat 64' that is mounted on the head 3 (not shown), a conduct plate 68' that is mounted adjacent the seat 64' and connecting to a contact of the illuminant 4, and a screw 66' that is screwed between the seat 64' and the conductive plate 68' for adjusting the distance between the adjustable pole 62' and the control pole 61'. The conductive plate 68' has a pair of position holes 682, and wherein the seat 64' has a pair of position rods 642 protruding thereon for guiding the conductive plate 68' sliding on the position rods 642.

Figure 5:
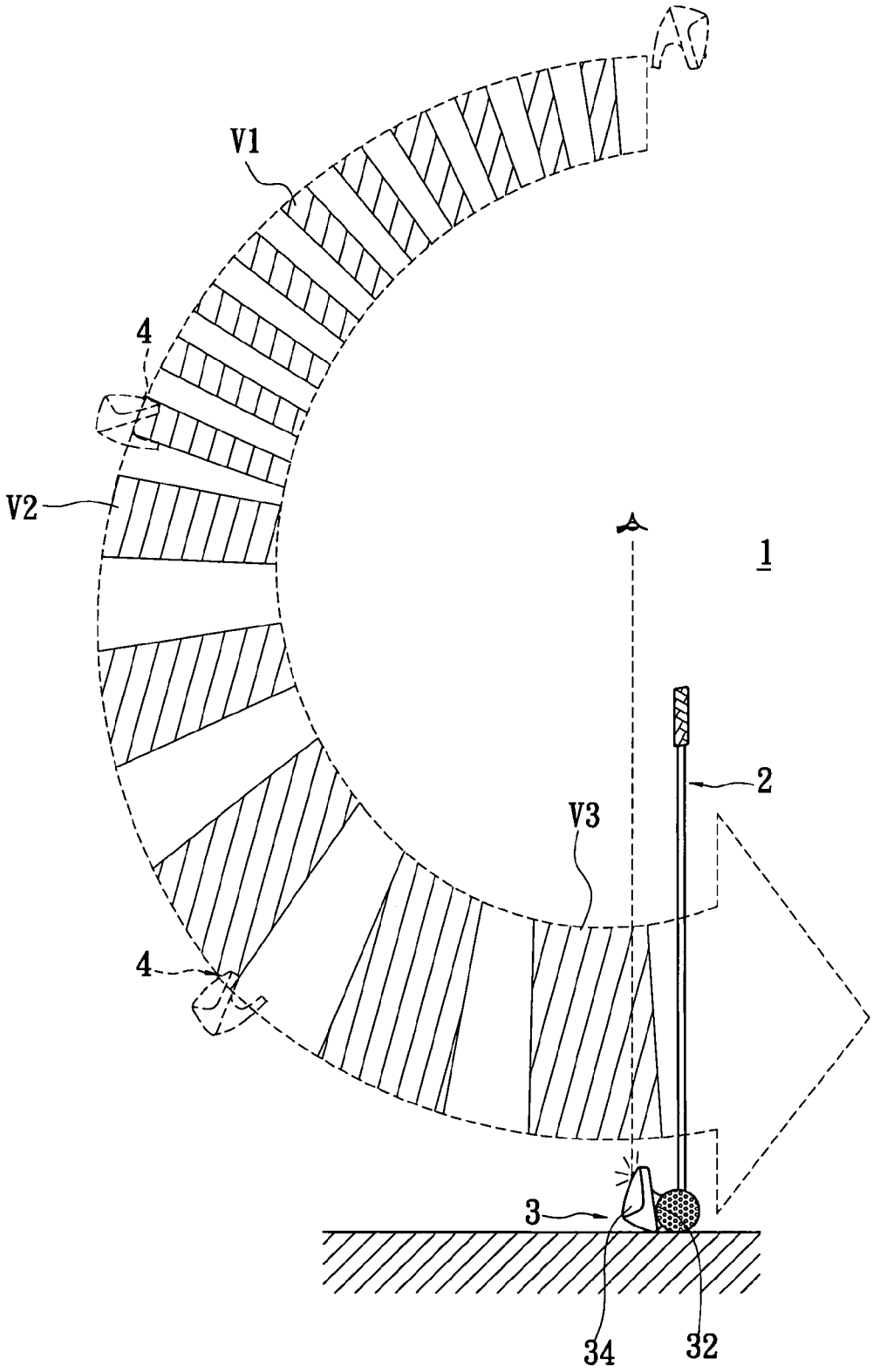
FIG. 5 is a perspective view of a golf club according to the present invention during swinging.

Referring to the FIG. 5 which is showing a proper swinging condition, V1, V2, V3 signify swinging velocities and the width of the arrow signifies the strength of swinging force. A normal strength-exerting condition is swinging at a slower velocity during lifting the golf club and the upper section of down swinging. When swinging down to the V2, start to accelerate the golf club 1; and when swinging down to the V3, pour all strength. Therefore an accurate swinging is really exerting strength at the V3 and has a larger acceleration. The centrifugal switch 6 is actuated by centrifugal force will turn on the illuminant 4 by a predetermined-strength centrifugal force during swinging the golf club 1 and will light to provide a coach observing the body harmony and strength-exerting condition of the golfer.

In another word, if the illuminant 4 lighting means the golf club 1 reaching a predetermine velocity and resulting a predetermine force strength. Normally, the illuminant 4 should light at the V3 section, and the illuminant 4 should not light at upper section because the centrifugal force is weaker.

Figure 6:
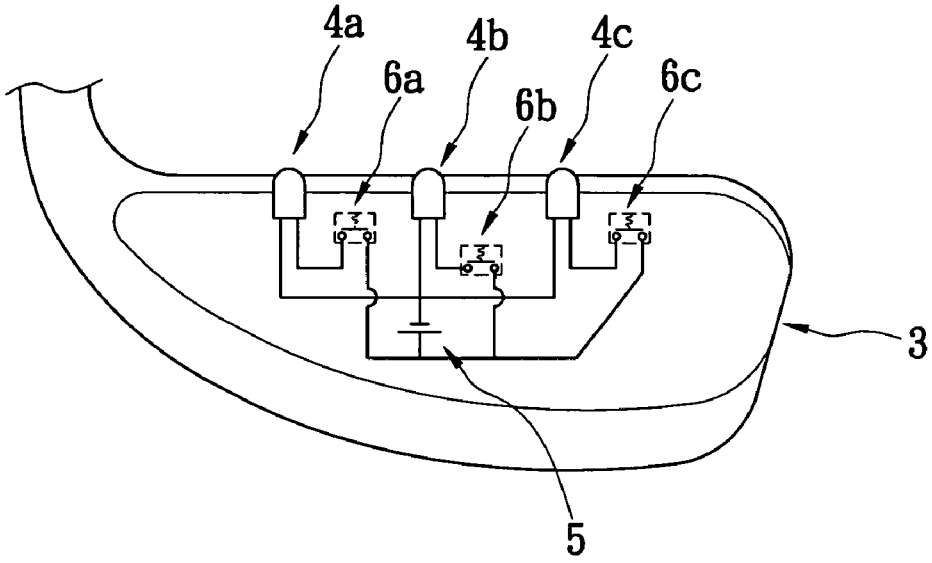
FIG. 6 is a circuit diagram of another embodiment according to the present invention.

Referring to the FIG. 6, which is a circuit diagram of another embodiment according to the present invention, the golf club 1 comprises three centrifugal switches 6*a*, 6*b*, 6*c*, and three illuminants 4*a*, 4*b*, 4*c* of different colors which are parallel connecting to the centrifugal switches 6*a*, 6*b*, 6*c*. The centrifugal switches 6*a*, 6*b*, 6*c* are respectively actuated at different-strength centrifugal forces to represent. For example the illuminant 4*a* is green color for lighting at a weak force, the illuminant 4*b* is yellow color for lighting at a middle force, and the illuminant 4*c* is red color for lighting at a large force. Therefore, that is be contributive to observe the body harmony and strength-exerting condition of golfers.

Figure 7:
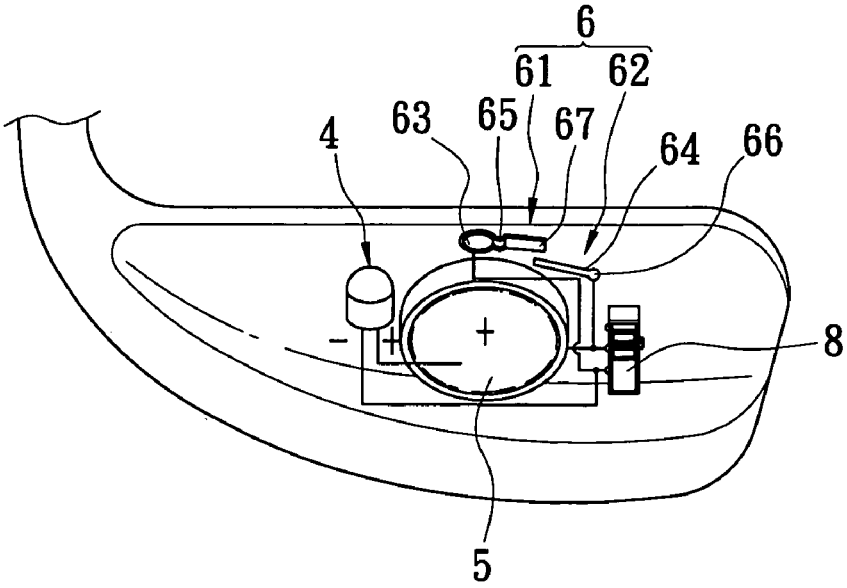
FIG. 7 is a back view of the golf club according to third embodiment of the present invention.

Referring to the FIG. 7, which is a back view of the golf club according to third embodiment of the present invention, the golf club 1 further comprises a switch 8 that is parallel connecting to the centrifugal switch 6; thereby the illuminant 4 can light continually for showing a swing path during swinging the golf club 1.

To sum up the advantages and functions of the present invention are as followed:

1. The golf club for showing swing condition can use as a golf education tool. The centrifugal switch can show the body harmony and strength-exerting condition of golfer during swinging process.
2. The golf club also can show the swing path for forecasting the ball falling point. When the swing path is curved inwardly, or lineally, or outwardly, that will cause ball flying differently.
3. The golf club for showing swing condition can cooperate with video-recording and provide the coach an analysis means.

It is to be understood, however, that even though numerous characteristics and advantages of the present invention have been set forth in the foregoing description, together with details of the structure and function of the invention, the disclosure is illustrate only, and changes may be made in detail, especially in matters of shape, size, and arrangement of parts within the principles of the invention to the full extent indicated by the broad general meaning of the terms in which the appended claims are expressed.

What is claimed is:

1. A golf club for showing a swing condition, the golf club having a shaft and a head connecting to the shaft, the head having a striking face, and the golf club comprising:

a visible illuminant exposed outside a surface of the head with an upward angle;

a battery for providing electrical power to the illuminant; and a centrifugal switch actuated by centrifugal force and mounted on a surface of the head opposite the striking face for controlling a circuit between the battery and the illuminant, the centrifugal switch having an elastic control pole and a fixed pole fixed on the head, the control pole being movable along a direction of centrifugal force during swinging the golf club to contact with the fixed pole, the control pole having a first fixed portion fixed on the head, an elastic portion extending upwardly from the first fixed portion, and a movable first contact portion connecting with the elastic portion; the fixed pole having a second fixed portion fixed on the head and a second contact portion connecting with the second fixed portion and positioned on a moving path of the first contact portion; whereby the illuminant being lit by a predetermined centrifugal force during swinging the golf club for demonstrating a golfer's body harmony and strength-exerting condition.

2. The golf club as claimed in claim 1, wherein the illuminant is an LED (Light Emitting Diode).

3. The golf club as claimed in claim 1, wherein the illuminant, the battery and the centrifugal switch are fixed on a back of the head opposite the striking face.

* * * * *

UNITED STATES PATENT AND TRADEMARK OFFICE

CERTIFICATE OF CORRECTION

PATENT NO. : 6,913,542 B1 
DATED : July 5, 2005
INVENTOR(S) : Chin-Te Hu, Yung-Tsao Chou and Chin-Chang Hu It is certified that error appears in the above-identified patent and that said Letters Patent is hereby corrected as shown below:

Title page,
Item [76], Inventors, add; -- Chin-Chang Hu, No. 211-13, Chu Kuang Rd., Chungho City, Taipei Hsien (TW) --.

Signed and Sealed this

Twenty-third Day of August, 2005

JON W. DUDAS
*Director of the United States Patent and Trademark Office*